US005428688A

United States Patent [19]

Becker et al.

[11] Patent Number: 5,428,688

[45] Date of Patent: Jun. 27, 1995

[54] VOICE TRANSMISSION SYSTEM WITH REMOTE MICROPHONE

[75] Inventors: Jack J. Becker, Solon; Joseph A. Birli, South Euclid; Alfred Bauer, Parma, all of Ohio

[73] Assignee: Audiopack Sounds Systems, Cleveland, Ohio

[21] Appl. No.: 38,456

[22] Filed: Mar. 29, 1993

[51] Int. Cl.[6] ..... H04R 25/00

[52] U.S. Cl. ..... 381/168; 381/169

[58] Field of Search ..... 381/168, 187, 169, 183; 367/132; 379/175

[56] References Cited

U.S. PATENT DOCUMENTS

| | | | |
|---|---|---|---|
| 1,139,177 | 5/1915 | Ganzer . | |
| 1,242,672 | 10/1917 | Finley . | |
| 1,344,349 | 6/1920 | Mickelson . | |
| 1,656,914 | 1/1928 | Hart . | |
| 1,666,216 | 4/1928 | Mowat . | |
| 2,123,196 | 7/1938 | Millard . | |
| 2,165,856 | 7/1939 | Howey . | |
| 2,847,506 | 8/1958 | Gray et al. . | |
| 2,942,072 | 6/1960 | Cunningham . | |
| 2,950,360 | 8/1960 | Duncan . | |
| 2,953,129 | 9/1960 | Bloom et al. | 128/146 |
| 3,180,333 | 4/1965 | Lewis . | |
| 3,181,531 | 5/1965 | Angioletti . | |
| 3,243,511 | 3/1966 | Erdman et al. . | |
| 3,310,736 | 3/1967 | Bayly et al. . | |
| 3,314,424 | 4/1967 | Berman . | |
| 3,659,056 | 4/1972 | Morrison et al. . | |
| 3,736,379 | 5/1973 | Kagan . | |
| 3,764,748 | 10/1973 | Branch et al. . | |
| 3,850,168 | 11/1974 | Ferguson et al. . | |
| 3,881,056 | 4/1975 | Gibson et al. . | |
| 4,010,334 | 3/1977 | Demeter . | |
| 4,072,831 | 2/1978 | Joscelyn . | |
| 4,194,096 | 3/1980 | Ramsey . | |
| 4,237,341 | 12/1980 | Richards . | |
| 4,258,229 | 3/1981 | Eggert et al. . | |
| 4,374,301 | 2/1983 | Frieder, Jr. | 179/1 R |
| 4,400,591 | 8/1983 | Jennings et al. . | |
| 4,471,174 | 9/1984 | Nava . | |
| 4,508,936 | 4/1985 | Ingalls | 179/82 |
| 4,683,588 | 7/1987 | Goldberg . | |
| 4,736,740 | 4/1988 | Parker et al. . | |
| 4,756,308 | 7/1988 | Ryback . | |
| 4,957,106 | 9/1990 | Vandeputte . | |
| 4,961,420 | 10/1990 | Cappa et al. . | |
| 4,980,926 | 12/1990 | Noetzel . | |
| 4,985,922 | 1/1991 | Kolbert . | |
| 5,060,308 | 10/1991 | Bieback . | |
| 5,138,666 | 8/1992 | Bauer et al. . | |

FOREIGN PATENT DOCUMENTS

| | | |
|---|---|---|
| 492664 | 9/1938 | United Kingdom . |
| 549518 | 11/1942 | United Kingdom . |
| 2165721 | 4/1986 | United Kingdom . |

OTHER PUBLICATIONS

Supplemental IDS filed Aug. 5, 1993, in corresponding Application Ser. No. 07/792,804; filed Nov. 15, 1991 and entitled "Voice Transmission System".

*Primary Examiner*—Curtis Kuntz
*Assistant Examiner*—Sinh Tran
*Attorney, Agent, or Firm*—Calfee Halter & Griswold

[57] ABSTRACT

A voice transmission system for a conventional gas mask or face mask includes an amplifier body and a remote microphone assembly. The amplifier body encloses an amplifier electronic components assembly, a speaker and one or more batteries, and is designed to be attached with a belt clip to the belt of a user. The microphone assembly is electrically connected by a flexible cord to the amplifier assembly and is designed to be removably coupled to the face mask. The microphone assembly includes a microphone and a microphone adapter. The microphone adapter includes a resilient mounting bracket which can be easily coupled to and uncoupled from the exhalation passage of the mask without penetration or structural modification of the mask such that the microphone is proximate a check valve in the exhalation passage of the mask. The microphone is designed to receive a person's voice through or around the check valve in the exhalation passage of the mask and communicate a signal to the amplifier assembly. The amplifier assembly then amplifies the voice signal, and the speaker externally transmits the signal.

6 Claims, 3 Drawing Sheets

VOICE TRANSMISSION SYSTEM WITH REMOTE MICROPHONE

FIELD OF THE INVENTION

The present invention relates to voice transmission or communication systems for gas masks or face masks.

BACKGROUND OF THE INVENTION

Protective gas masks or face masks are well known in the art. These masks provide breathing capabilities while protecting the mask user from noxious gases, smoke, paint fumes, etc. However, people wearing the masks often have a need to communicate with one another, particularly during emergency situations. Accordingly, several voice transmission or communication systems have been developed for this purpose.

For example, Lewis U.S. Pat. No. 3,180,333, discloses a gas mask communication system including a generally U-shaped holder connected to the mask. Preferably, the holder includes the amplification speaker in one end portion and the batteries for operating the speaker system in another end portion. The batteries and amplification system are connected in circuit with a microphone inside the mask adjacent the user's mouth. Additional or parallel speakers can be plugged into the Lewis mask communication system including, for example, a speaker attached to the belt of the wearer.

Noetzel, U.S. Pat. No. 4,980,926; Ingalls U.S. Pat. No. 4,508,936; Lewis, U.S. Pat. No. 3,180,333; Bloom U.S. Pat. No. 2,953,129; and Duncan U.S. Pat. No. 2,950,360 disclose face mask communication systems having a microphone carried in the face mask and an amplifier or speaker connected to the microphone by a cord. The amplifier or speaker is supported elsewhere, such as around the waist of the user. Such communication systems having a remote amplifier and speaker are particularly useful where the mask is a half-piece mask and does not have the ability to support the relatively heavy and bulky amplifier and speaker assembly.

The above-identified voice transmission and communication systems however, can have certain disadvantages. In particular, during installation (or removal and/or replacement) of some of these systems, certain components of the communication system, and in particular the microphone and related electronics, penetrates and structurally alters the mask in order to reproduce the user's voice. For example, Lewis shows a threaded portion for the microphone which extends through an aperture formed in the mask. However, penetrating and altering the mask can raise safety issues, can require additional assembly, and can make it difficult to remove and/or replace the voice transmission system, particularly during emergency situations.

Other systems have been developed which do not penetrate the mask. For example, Ingalls in one embodiment shows a vibration pickup located within a receptacle adhesively secured to the surface of the face mask to receive, amplify, and externally transmit vibrations received through the mask. In another embodiment, Ingalls shows a microphone located within the mask which is acoustically coupled to the pick-up assembly on the exterior of the mask. Noetzel shows a similar design using phototransmission coupling. However, these systems require additional components which are bonded (e.g., adhesively) to the exterior and/or interior surfaces of the mask. Further, in Noetzel and in the one embodiment of Ingalls, these systems require the microphone to be located within the face mask, which makes it difficult to remove and/or replace the microphone during use.

SUMMARY OF THE INVENTION

The present invention provides a lightweight voice transmission system which can be easily installed on a gas mask or face mask (and entirely removed and/or replaced) without penetrating or structurally altering the mask, even when the mask is in use.

The voice transmission system includes an amplifier body enclosing an amplifier electronic components assembly, a speaker, and at least one battery. The amplifier electronic components assembly includes an amplifier circuit board which, along with the speaker, is mounted within the body and enclosed by a perforated end cap. The body of the voice transmission system is designed to be worn on the belt of a user, and to this end, a belt clip is provided.

The voice transmission system also includes a microphone assembly which is remote from the amplifier body and is electrically connected to the amplifier body by a flexible cord. The microphone assembly includes a microphone mounted within a microphone adapter. The microphone adapter includes a resilient mounting bracket which connects the microphone assembly to existing structure on the mask, e.g., the exhalation passage of the face mask. The mounting bracket couples the microphone assembly to the mask such that the microphone is proximate the check valve in the exhalation passage. Thus, when the user speaks, sound traveling through or around the check valve in the exhalation passage impinges directly on the microphone in the microphone assembly. The amplifier assembly then amplifies the voice signal, and the voice signal is externally transmitted by the speaker.

The microphone assembly of the voice transmission system can be coupled to the mask by grasping and forcing or "popping" the mounting bracket around the exhalation passage. Spring clips on the mounting bracket resiliently deform to tightly grasp the outer surface of the exhalation passage. The microphone assembly can be uncoupled from the mask by merely grasping and pulling outwardly on the microphone assembly.

Accordingly, it is a basic object of the present invention to provide a compact and lightweight voice transmission system which can be easily coupled to or uncoupled from a face mask or gas mask without penetrating or structurally altering the mask.

It is another object of the present invention to provide a voice transmission system which can be easily coupled to and uncoupled from the existing exhalation passage of a gas mask or face mask.

It is yet another object of the present invention to provide a voice transmission system having an amplifier assembly and speaker which are mounted to the belt of a user, and a remote microphone assembly which can be easily coupled to or uncoupled from existing structure on the mask proximate the check valve in the mask.

Further objects of the present invention will become apparent from the following detailed description and accompanying drawings which form a part of the specification.

DETAILED DESCRIPTION OF THE DRAWINGS

DETAILED DESCRIPTION OF THE PREFERRED EMBODIMENT

Figure 1A:
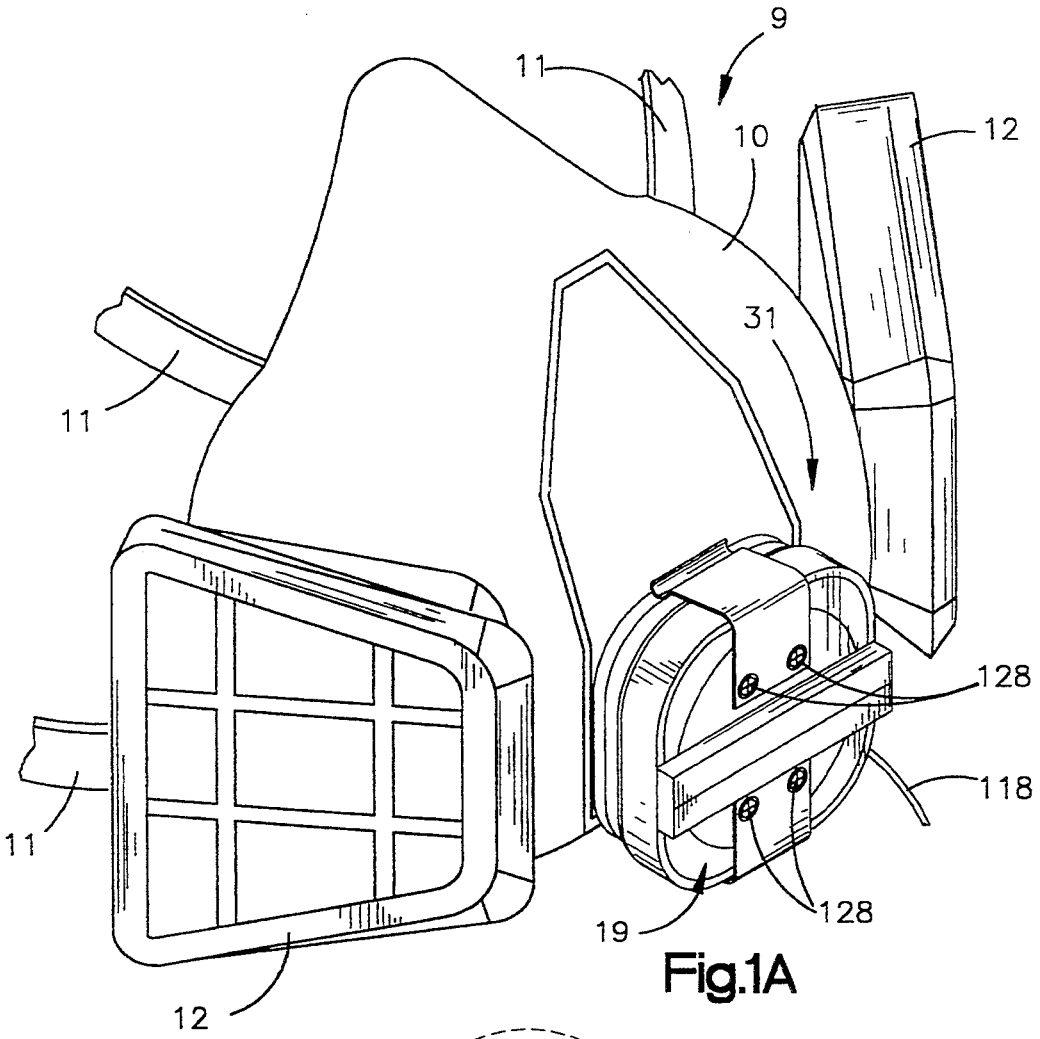
FIG. 1A is an enlarged perspective view of the microphone assembly of the present invention assembled or installed on a gas mask or face mask.
Figure 1B:
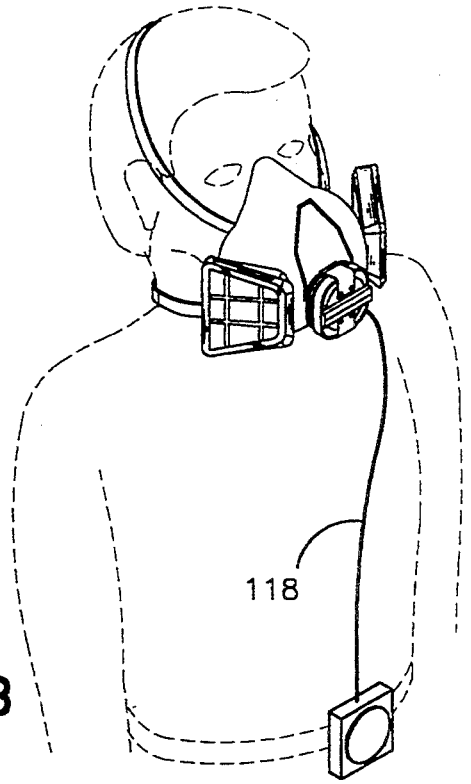
FIG. 1B is a perspective view of the microphone assembly of FIG. 1A shown electrically connected by a cord to an amplifier body attached to the belt of a user.
Figure 2:
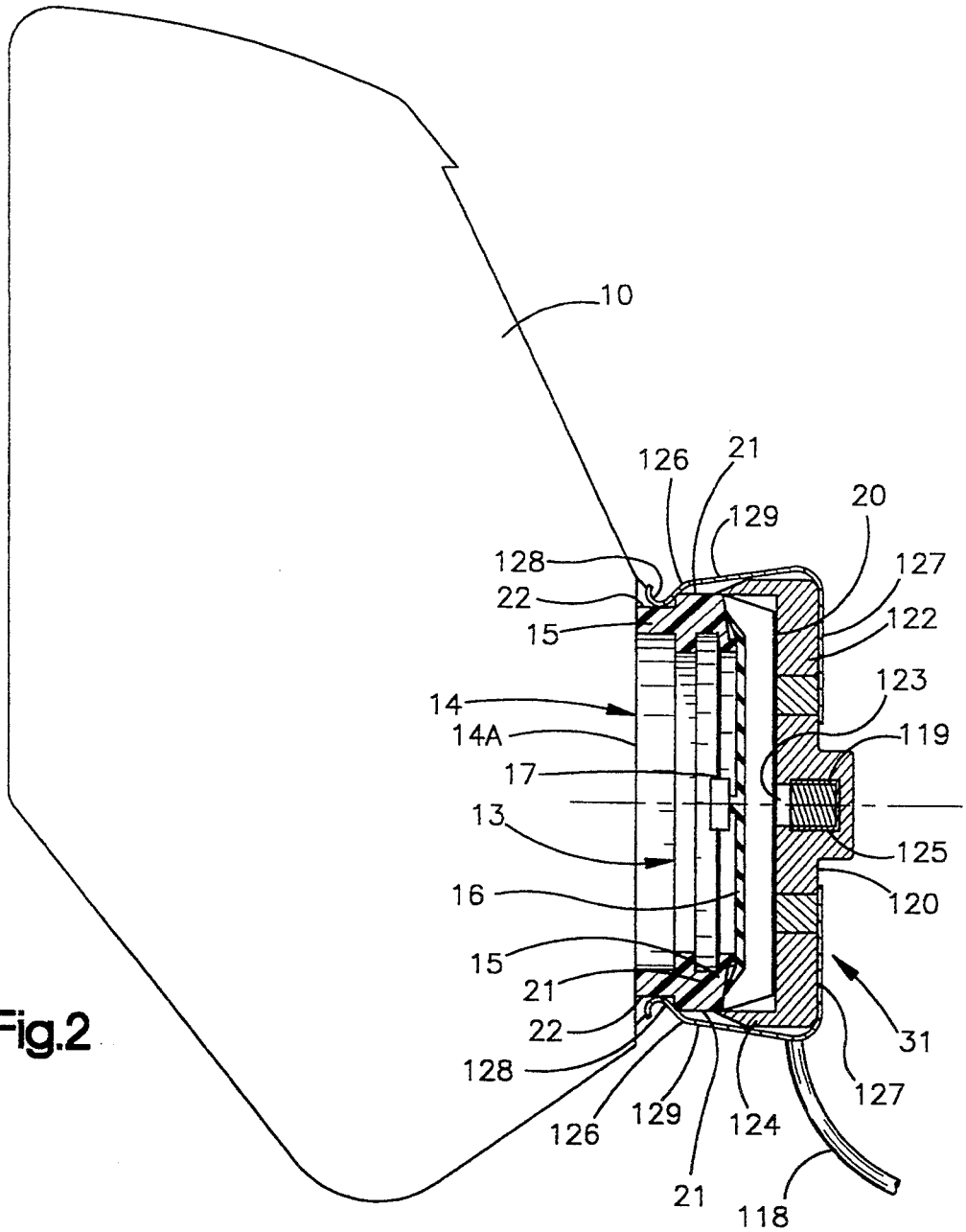
FIG. 2 is a cross-sectional side view of the exhalation passage of the mask and of the microphone assembly connected thereto.

Referring to the drawings, and initially to FIGS. 1A, 1B and 2, a gas mask or face mask, indicated generally at 9, includes a face piece 10 held tightly against the head of the user by straps 11 encircling the back of the head. Upon inhaling, a person wearing the mask 9 receives filtered air drawn through conventional inhalation filters 12 on opposite sides of the mask; and upon exhaling, the person exhausts the air through a conventional exhalation passage, indicated generally at 13, located on the mask centrally between the inhalation filters 12.

The inhalation filters and the exhalation passage have one-way check valves mounted therein to prevent noxious gases or contaminants entrained in the air from entering the end of face piece 10, as is generally known in the art. For example, as shown most clearly in FIG. 2, exhalation passage 13 includes a hollow central bore 14 having its inner end 14A proximate a person's mouth wearing the mask, and a frame 15 which extends inwardly into the bore 14 at the outer end 20 of the passage. A check valve 16 is mounted to a central post 17 connected to the outer frame 15. The periphery of the check valve 16 is supported by and normally seals against the outer frame 15 to prevent gasses or contaminants from entering the end of face piece 10. However, upon exhaling, the check valve 16 is moved away from the frame 15 by air pressure, and the exhaled air passes out of the mask between the frame 15 and the check valve 16. The inhalation filters 12 are mounted to openings with similar one-way check valves (not shown) to allow air to be drawn inwardly into the mask through the filters.

The frame 15 of the exhalation passage 13 tapers outwardly from the outer end 20 to a shoulder 21, and then narrows inwardly to a thinner neck portion 22. The exhalation passage 13 can be formed in one piece with face piece 10, however generally the exhalation passage 13 is formed separately from face piece 10 during manufacture and is then inserted through an aperture in the face piece and sealed therein appropriately. It is also known in certain mask designs that a removable perforated grill or end cap (not shown) can be attached to the exhalation passage of the mask to cover and protect the check valve in the passage.

Such a mask illustrated in FIGS. 1A, 1B and 2 is typically referred to as a "half-mask" and is available from a number of suppliers, including Minnesota Mining and Manufacturing (3M). However, it should be apparent to those skilled in the art that the mask illustrated herein is only exemplary in nature, and other types of face masks or gas masks (such as "full-face" masks) can be used with the present invention.

A person wearing a mask such as described above often needs to communicate with other people in the area. As such, when the person speaks, the voice is transmitted through the mask primarily by passing around the open check valve 16. The voice is also transmitted to some extent by the vibration of the check valve and the mask itself. In the case of a full-face mask, the check valve 16 is typically replaced by a voice diaphragm mounted within and sealing the voice emitter passage in the mask, in which case the voice is transmitted directly through the voice diaphragm. The term "membrane" as used herein is intended to cover any type of check valve, diaphragm or other device located within a passage of the mask which allows the person's voice to be transmitted therethrough or therearound. Further, the term "passage", as used herein, is intended to cover any type of passage or channel which is normally formed in the mask proximate the mouth and which has some communication function, such as to direct the voice outside the mask (e.g., an exhalation passage in the half-mask, or the voice emitter passage in a full-face mask).

To provide enhanced communication with other people in the area, a voice transmission system can be releasably coupled to the exhalation passage 13 of the mask. The voice transmission system includes an amplifier body, indicated generally at 30, for attachment to the belt of a user; and a microphone assembly, indicated generally at 31, designed to be coupled to the face mask 9 remote from the amplifier body 30. The microphone assembly 31 receives the user's voice through or around the check valve 16 in the mask, and the amplifier body 30 amplifies and externally transmits the voice.

Figures 3, 4, 5:
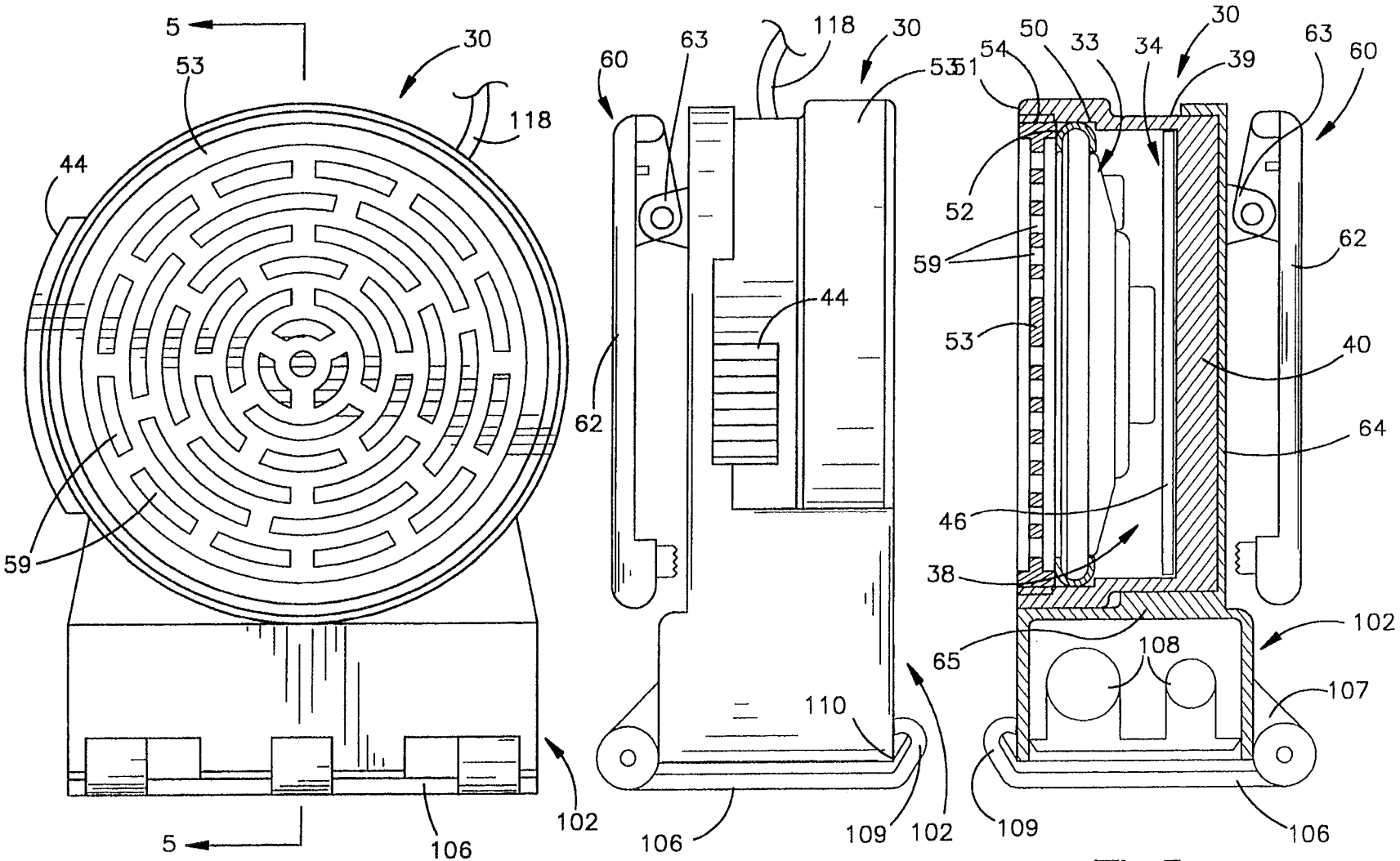
FIG. 3 is an enlarged front view of the amplifier body of FIG. 1B shown removed from the belt of the user.
FIG. 4 is a left side view of the amplifier body of FIG. 3.
FIG. 5 is a cross-sectional right side view of the amplifier body taken generally along the plane described by the lines 5—5 in FIG. 3.

As illustrated in FIGS. 3–5, the amplifier body 30 at least partially encloses a speaker, indicated generally at 33, and an amplifier electronic components assembly, indicated generally at 34. The amplifier body 30 is preferably formed from integrally molded, relatively rigid, lightweight plastic material. The amplifier body 30 includes a cup-shaped main compartment, indicated generally at 38, formed by side wall 39 and end wall 40. The main compartment 38 houses the amplifier electronic components assembly 34, which includes a control switch 44 (FIGS. 3, 4) and an amplifier circuit board 46. The control switch 44 for the present invention preferably comprises a reed-type switch element which allows external control of the voice transmission system without compromising the integrity of the main compartment 38. A preferred reed-type switch for the present invention is sold by HASCO components of Bellrose Village, N.Y. 11001, under Model No. ORD225.

The circuit board 46 for the amplifier electronic components assembly is retained within main compartment 38 by e.g., screws (not shown), which are received within the end wall 40, or by some other conventional fastening means. The circuit board includes capacitors, resistors and other electrical components which filter and amplify the user's voice received from the microphone assembly 31. The amplifier assembly in turn provides an amplified signal to the speaker 33, also located within the main compartment 38. The electrical components for the amplifier assembly are described in more detail in U.S. patent application Ser. No. 07/433,601, filed Nov. 8, 1989 entitled "Voice Transmission System", and assigned to the assignee of the present invention, which is incorporated herein by reference.

The speaker 33 for the voice transmission system is located in a first shoulder 50 formed around the outer lip 51 of compartment 38. A rubber annular gasket 52 can be interposed between the speaker 33 and the first shoulder 50 for shock and water resistance and to prevent dust or other particles from contaminating the circuit board 46. The speaker 33 receives the amplified signal from the circuit board 46 and externally transmits the amplified signal. Preferably, speaker 33 is an eight ohm, 2 watt speaker available from a number of suppliers including Minneapolis Speaker Co., Minneapolis, Minn.; and International Components, Melville, Tex.

The speaker 33 and amplifier assembly 34 are enclosed within the main compartment 38 by a removable end cap or speaker grille 53, which is threadedly mounted within a second shoulder 54 formed in the body 30. The end cap 53 retains the speaker 33 and rubber annular gasket 52 within the first shoulder 50 in main compartment 38. The end cap 53 is perforated, as indicated at 59, to enable the user's voice to be transmitted from the speaker externally of the amplifier body.

For remote attachment of the amplifier body to the user, the body further includes a belt clip, indicated generally at 60. The belt clip 60 comprises a clip member 62 which is pivotally mounted by flange 63 to a rear plate 64. Rear plate 64 is mounted flush to the outer surface of end wall 40 by, e.g., adhesive or other suitable means. The rear plate 64 includes a bottom portion 65 which extends flush along the bottom sidewall 39, and a top portion 66 which extends flush along a portion of the top of sidewall 39, such that the belt clip 60 can be located over the belt of the user to support the body of the voice transmission system.

To supply power for the amplifier assembly and speaker, a rectangular battery compartment, indicated generally at 102, is located along the bottom of the amplifier body 30. The battery compartment 102 is formed by rear plate bottom portion 65 and by sidewalls 103 which extend outwardly and downwardly from bottom portion 65. Battery compartment 102 is designed to enclose batteries 108, which are electrically interconnected with the amplifier assembly 34, microphone assembly 31, speaker 33 and switch 44. Preferably, batteries 108 comprise commercially-available, replaceable, nine-volt alkaline batteries.

The battery compartment 102 includes a cover 106 which is pivotally attached to flanges 107 formed with rear plate 64. Cover 106 provides easy external access to batteries 108 contained in the compartment. Cover 106 is held securely to compartment 102 by clasp member 109 which locks over the outer lip 110 of battery compartment 102 and allows easy grasping by a user's fingers. By grasping the clasp member 109 of cover 106 and pivoting the cover away from the battery compartment, the batteries 108 are easily accessible. With the cover opened, batteries 108 can be replaced while the microphone assembly 31 is mounted to the mask and the mask is positioned on a user's face. The cover 106 can be easily closed by pushing the cover against the battery compartment 102 and locking the clasp member 109 around the outer lip 110.

Further, in order to ensure that the compartment 102 is watertight, a rubber gasket (not shown) can be interposed between cover 106 and the outer lip 110 of the battery compartment 102. The gasket can be disposed along the edges of lip 110 to form a seal with the cover 106. It should be apparent to those skilled in the art that the particular structure of the cover 106 is only exemplary in nature and that other means for permitting easy access to the battery compartment is also to be anticipated, such as a fully removable cover.

Figure 6:
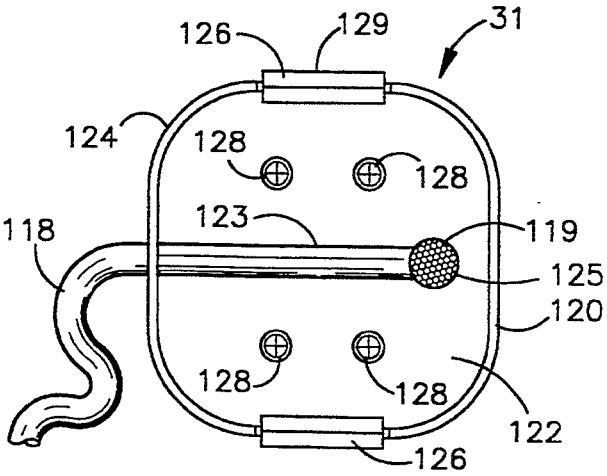
FIG. 6 is a top plan view of the microphone assembly for the voice transmission system shown uncoupled from the gas mask or face mask.

Referring now to FIGS. 1B, 2 and 6, the amplifier body 30 of the voice transmission system is electrically connected to the remote microphone assembly 31 by a flexible cord or conductor 118. Although not shown, the cord or conductor 118 has jacks at one or both ends which allow the cord or conductor to be readily connected with corresponding plugs in the microphone assembly 31 and/or the amplifier body 30.

The microphone assembly 31 includes a microphone 119, and a microphone adapter 120. The microphone adapter 120 includes a base plate 122 and an outwardly extending collar 124. The base plate 122 and collar 124 of the microphone adapter 120 are preferably integrally formed in one piece from relatively rigid, lightweight plastic material.

The cord 118 from the amplifier body extends through an opening (not shown) in the collar wall and extends along a channel 123 formed in the inner surface of base plate 122 to the microphone 119. The microphone is received and mounted within an opening 125 formed in base plate 122. A preferred microphone for the present invention is marketed by the Primo Mic. Inc. of MeKinney, Tex. under the mark/designation EM-125T.

The microphone assembly 31 is designed to be connected to the exhalation passage of the face mask in order to locate the microphone 119 proximate the check valve 16 in the face mask. To this end, a mounting bracket consisting of a pair of resilient, L-shaped spring clips 126, is mounted to the base plate 122 of the microphone adaptor. The spring clips 126 are preferably formed from metal and are located on opposite sides of the microphone adapter. The base 127 of each spring clip is attached to the base plate 122 using e.g., rivets or screws 128, while the legs 129 of the spring clips extend outwardly from the adapter along opposite sides of mounting collar 124.

As illustrated most clearly in FIG. 2, the mounting bracket is designed to couple the microphone assembly to existing structure on the face mask, e.g., to the exhalation passage 13. The spring clips 126 of the mounting bracket enable the microphone assembly to be coupled to the face mask by resiliently deflecting as the adapter is pushed onto the exhalation passage 13. As the microphone assembly is pushed onto the exhalation passage, the distal ends of the spring clips 126 bend outwardly as the clips pass over shoulder 21, then contract around neck portion 22 of the exhalation passage to couple the microphone assembly firmly to the face mask 9. Further, spring detentes 128 can be formed at the distal ends of the spring clips which are received within the neck portion 22 to facilitate grasping the exhalation passage. Of course, more than two spring clips can be used if necessary to firmly couple the microphone assembly to the exhalation passage.

At this point, the collar 124 of the microphone adapter 120 surrounds at least the end portion of the exhalation passage and the outer end 20 of the exhalation passage generally abuts the base plate 122 of the microphone adapter. However, enough clearance is given between the microphone assembly and the exhalation passage so as not to interfere with the exhalation valve in the passage. Further, the base plate 122 of the microphone adapter can have openings formed therein so as not to interfere with the user's exhalation through the exhalation passage of the mask. Thus, when the user speaks, the sound traveling through or around the check valve in the exhalation passage impinges directly upon the microphone 119 in the microphone assembly. The microphone assembly 31 can be easily uncoupled from the face mask by grasping the microphone assembly 31 and pulling the microphone assembly away from the face mask, at which point the spring clips bend outwardly as the microphone assembly is uncoupled from the mask.

It should be apparent, however, that the mounting bracket described above is only one exemplary manner in which to releasably couple the microphone assembly 31 to the face mask. Other ways for releasably coupling the microphone assembly to the face mask are also within the scope of the present invention, such as for example: (1) having a resilient collar which can clip around the entire outer circumference of the exhalation passage; (2) having a resilient threaded portion formed on the outer surface of the mounting bracket which is received within a corresponding threaded portion formed in the central bore 14 of the exhalation passage; (3) having elastic mounting straps extending outwardly from the microphone assembly which can be located around certain structure on the mask (e.g., around both inhalation passages/filters 12); or (4) having a first adapter which is removably coupled to the exhalation passage of the mask, and which thereafter enables the microphone adapter to be coupled directly to the first adapter.

Some of these alternative means for releasably coupling the microphone assembly to structure on the face mask are further described and illustrated in applicants' U.S. Pat. No. 4,901,356, entitled "Voice Transmission System." Of course, other variations than what is described above are also contemplated, as long as the microphone assembly is coupled to the mask with the microphone proximate to the check valve in the mask and that the microphone assembly can be easily removed therefrom (and/or replaced).

Being able to easily couple and uncouple microphone assembly from the face mask in this manner makes the voice transmission system particularly suited for situations where the hands of the user are enclosed in bulky gloves or mittens. Moreover, it is believed that this feature provides additional safety for the mask user if the microphone assembly or cord is struck or becomes tangled in an object e.g., a tree branch. The microphone bracket normally couples the microphone assembly to the mask with a predetermined amount of resistance to prevent the microphone assembly from unwanted disconnection therefrom (e.g., to prevent the microphone assembly from simply "falling off" the mask). However, the microphone assembly of the voice transmission system will automatically disconnect i.e., "pop off" from the exhalation passage in the mask without pulling the mask off the face of the user in the event the microphone assembly is struck with enough force from e.g., the side, or the cord is pulled hard enough.

After the microphone assembly of the voice transmission system is installed on the mask, the amplifier body is attached to the belt of the user and the cord 118 is plugged into both the microphone assembly and the amplifier body. The user need only manually engage the control switch 44 to activate the system. When the system is activated, the microphone 119 is designed to receive the mask user's voice through or around the check valve in the exhalation passage. The signal from the microphone is communicated through cord 118 to the amplifier assembly 30 where it is amplified and externally transmitted through the speaker 33. If the batteries 108 powering the system become weak, the battery cover 106 can be easily removed and the batteries replaced.

Although the invention has been shown and described with respect to a certain preferred embodiment, it is obvious that equivalent alterations and modifications will occur to others skilled in the art upon their reading and understanding of the specification. The present invention includes all such equivalent alterations and modifications, and is limited only by the scope of the following claims.

What is claimed is:

1. A voice transmission system for use with a face mask having a passage, the passage including an inner end proximate a person's mouth wearing the face mask and an outer end having a membrane mounted thereon, said voice transmission system comprising:

a microphone assembly including: (i) a microphone for receiving the person's voice through or around the membrane, and (ii) a mounting unit for removably coupling said microphone assembly to the passage of the face mask such that said microphone is located proximate the membrane, said mounting unit including: (i) a base plate within which said microphone is mounted, (ii) a collar extending outwardly from said base plate, and (iii) a plurality of resiliently deflectable spring clips attached to said base plate and extending along the outer surface of said collar, said spring clips being designed to: (i) resiliently deflect during coupling of said microphone assembly to the passage, (ii) engage an outer surface of the passage with a predetermined amount of resistance when said microphone assembly is coupled to the passage, and (iii) resiliently deflect during uncoupling of said microphone assembly from the passage;

an amplifier body remote from said microphone assembly and substantially enclosing an amplifier assembly, a speaker, and a power source; and a conductor for electrically interconnecting said microphone with said amplifier assembly, said speaker, and said power source;

whereby said microphone receives the person's voice through or around the membrane at the outer end of the passage, said amplifier assembly amplifies the voice signal received from said microphone, and said speaker externally transmits the amplified voice signal.

2. A voice transmission system for use with a face mask having a passage, the passage including an inner end proximate a person's mouth wearing the face mask and an outer end having a membrane mounted thereon, said voice transmission system comprising:

a microphone assembly including: (i) a microphone for receiving the person's voice through or around the membrane, and (ii) a mounting unit for removably coupling said microphone assembly to the passage of the face mask such that said microphone is located proximate the membrane, said mounting unit engaging the passage of the face mask to couple said microphone assembly to the passage, said mounting unit being designed to: (i) resiliently deflect during coupling of said microphone assembly to the passage, (ii) engage the passage with a predetermined amount of resistance when said microphone assembly is coupled to the passage, and (iii) resiliently deflect during uncoupling of said microphone assembly from the passage;

an amplifier body remote from said microphone assembly and substantially enclosing an amplifier assembly, a speaker, and a power source; and a conductor for electrically interconnecting said microphone with said amplifier assembly, said speaker, and said power source;

whereby said microphone receives the person's voice through or around the membrane at the outer end of the passage, said amplifier assembly amplifies the voice signal received from said microphone, and said speaker externally transmits the amplified voice signal;

and wherein said mounting unit includes a plurality of resiliently deflectable members designed to engage an outer surface of the passage to couple said microphone assembly to the face mask.

3. A voice transmission system as in claim 2, wherein said mounting unit further includes a base plate within which said microphone is mounted and a collar extending outwardly from said base plate, said deflectable members being attached to said base plate and extending along the outer surface of said collar.

4. A voice transmission system as in claim 3, wherein said deflectable members comprise spring clips.

5. A voice transmission system as in claim 3, wherein said microphone is mounted in an opening in said base plate and said conductor has a portion which extends along a channel formed in said base plate to interconnect said microphone with said amplifier assembly, said speaker, and said power source.

6. A voice transmission system as in claim 2, wherein said mounting unit further includes a resilient collar designed to engage an outer circumference of the passage to couple said microphone assembly to the face mask.

* * * * *